US005760318A

United States Patent [19]

Yang

[11] Patent Number: 5,760,318

[45] Date of Patent: Jun. 2, 1998

[54] ACTUATING MEANS OF A MUSICAL BOX

[76] Inventor: Chin-Long Yang, No. 48, Lane 502, Wen Shyan Rd., Tainan City, Taiwan

[21] Appl. No.: 714,608

[22] Filed: Sep. 16, 1996

Related U.S. Application Data

[63] Continuation-in-part of Ser. No. 621,598, Mar. 26, 1996, Pat. No. 5,696,332.

[51] Int. Cl.[6] ..... G10F 1/06

[52] U.S. Cl. ..... 84/95.2; 40/457; 446/298

[58] Field of Search ..... 84/95.2, 95.1, 84/94.1, 94.2; 40/455, 457; 446/404, 297, 298

[56] References Cited

U.S. PATENT DOCUMENTS 5,567,892 10/1996 Huang ..... 84/95.2

*Primary Examiner*—Cassandra C. Spyrou
*Attorney, Agent, or Firm*—Morton J. Rosenberg; David I. Klein; Jun Y. Lee

[57] ABSTRACT

The present invention provides an actuating assembly of a musical box, in which a cluster gear is driven by a motor through a worm gear set, and the cluster gear employs a master gear connecting a driving gear in center portion, and mesh with epicyclical gears, coordinating with different linkages and the swing links with spin axle on the epicyclical gears, the dolls secured to the top portion of the spin axle can swivel and swing sidelong driving by the motor. A sensor is utilized to control the music in a standby or in a replay states.

3 Claims, 2 Drawing Sheets

ACTUATING MEANS OF A MUSICAL BOX

CROSS-REFERENCED TO RELATED APPLICATION

This is a Continuation-in-Part of U.S. patent application Ser. No. 08/621,598 filed at the U.S. Patent and Trademark Office on 26 Mar. 1996 now U.S. Pat. No. 5,696,332.

BACKGROUND OF THE INVENTION (1) Field of the Invention

The present invention relates to an actuating means of a musical box, and more particularly to an actuating means utilizing a sensing device to control a driving means to swivel and swing plural dolls sidelong.

(2) Prior of Art

The mechanical design of conventional musical boxes are mostly comprising a spiral power spring driving a cylinder which includes many projections on the surface thereof, these projections on the rolling cylinder can knock a reed to produce variety sounds. The rolling movement of the cylinder will produce a complete song. Accompanying the lovely music, one or plural dolls swivel themselves on pivot shafts. Obviously, the swiveling motion is very doll and simple.

An electronic musical box was later developed which includes an integrated circuit board having preset songs without the cylinder and the spiral power spring of the mechanical component. This design has a higher quality output and is able to play various songs in a continuous manner. This musical box is a manual controllable and requires to be switched off when playing.

OBJECTS AND SUMMARY OF THE INVENTION

It is the primary object of the present invention to provide an actuating means of a musical box in that a sensor controls the music to play and plural dolls to swivel and swing sidelong. The means comprises a cluster gear driven by a motor through a worm gear set in the box. The cluster gear employs a master gear connecting a driving gear in center portion meshing with a plurality of epicyclical gears, each epicyclical gear coordinates with a linkage and the swing links with spin axle of the epicyclical gears. This enables the dulls standing on the top of the spin axle to swivel and swing sidelong as driven by the motor. The sensor will automatically pause or restart playing of the music.

It is another object of the present invention to provide an actuating means of a musical box in that a clutch coupling is used to prevent the motor from overloading as the dull on the top of the spin axle is held on by an extra force. In order to do so, the driving gear is attached to a circular toothed connector and a center swivel member. In the normal state, they can join together to rotate synchronously. When an extra force holding the swivel member on, the toothed connector rotates until the extra force disappearing.

DETAILED DESCRIPTION OF PREFERRED EMBODIMENTS

Figure 1:
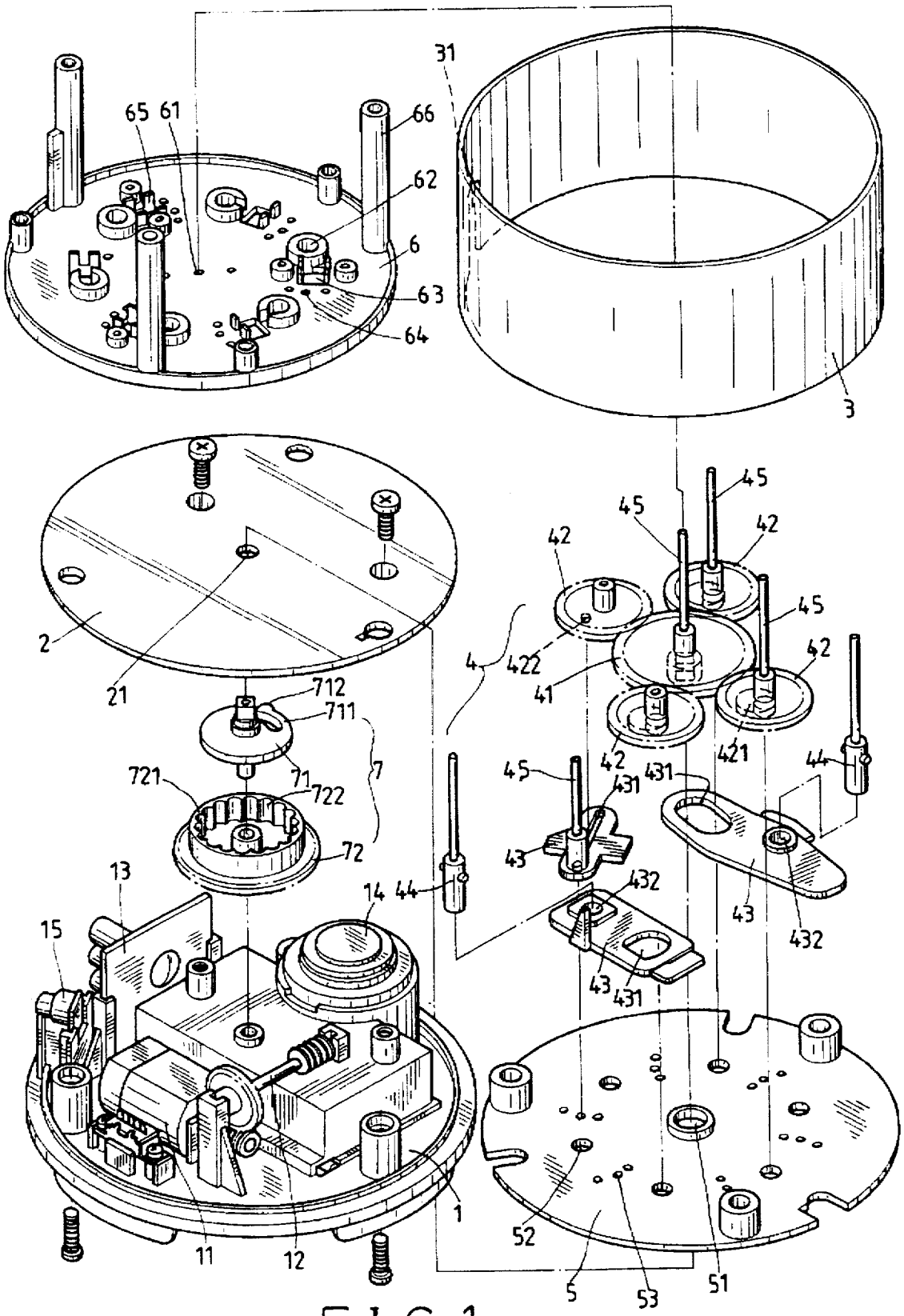
FIG. 1 is an exploded view of the present invention.

Referring to FIG. 1, the present invention comprises a base 1, a baffle 2, an apron 3, a base plate 5, a lid 6 and a cluster gear 4 mounted between the base plate 5 and the lid 6.

The base 1 includes a motor 11 secured on the top portion having its output axle linked through a worm gear set 12 with a driving gear 7. A circuit board 13 is fixed on one side and is connected to a loudspeaker 14. The motor 11 is electrically connected to a sensor 15 by a cord.

The baffle 2 is fastened on the base 1 having the center shaft of the driving gear 7 extending through a through hole 21 at center portion and inserted into a master gear 41 of the cluster gear 4 which will be described in the follows.

The driving gear 7 is composed of a swivel member 71 and a toothed connector 72 in a pivotal manner. The swivel member 71 has a flexure strip 711 formed at one side along the rim with a projection 712 extending upwardly from the free end thereof. The toothed connector 72 has a holder 721 on the top for the swivel member 71 seating therein and a circular wave-shaped recess 722 formed on the inner wall of the holder 721 to accommodate the projection 712 on the top portion of the flexure strip 711.

The circuit board 13 has a musical IC to play music through the loudspeaker 14 and is able to control the motor 11 to stop the music.

The apron 3 is a circular drum sleeved over the rim of the base 1, and includes a slotted hole 31 on one side corresponding to the receiver of the sensor 15.

The cluster gear 4 includes a center master gear 41, plural epicyclical gears 42 and plural linkages 43. Some of the epicyclical gears 42 are formed with cams 421 or lug dowels 422 at the bottom portion adapted to be extending into corresponding slotted holes 431 of the linkages 43. The holding holes 432 are formed on the linkage 43 for corresponding swing links 44 embedding therein. On the top portions of each epicyclical gear 42 and of each linkage 43, corresponding spin axles 45 are secured thereon.

The base plate 5 has a hub hole 51 at the center portion and several shaft holes 52 surrounding the hub hole 51 for securing the master gear 41 and the epicyclical gears 42 in place, and several pin holes 53 along the side of each shaft hole 52 for the spin axles 45 of the linkages 43 passing through.

The lid 6 includes a plurality of through-holes 61 and bushes 62, corresponding to the hub holes 51 and the shaft holes 52 on the base plate 5, for holding the cluster gear 4 in place. A plurality of openings 63 and pin holes 64 are formed between the bushes 62, and supporting lugs 65 formed on the opposite bottom sides of some of the openings 63 for holding the swing links 44 in a pivoting manner. Along the rim of the lid 6 extends several legs 66 upwardly for fixing purpose of the lid 6 to the base 1.

Figure 2:
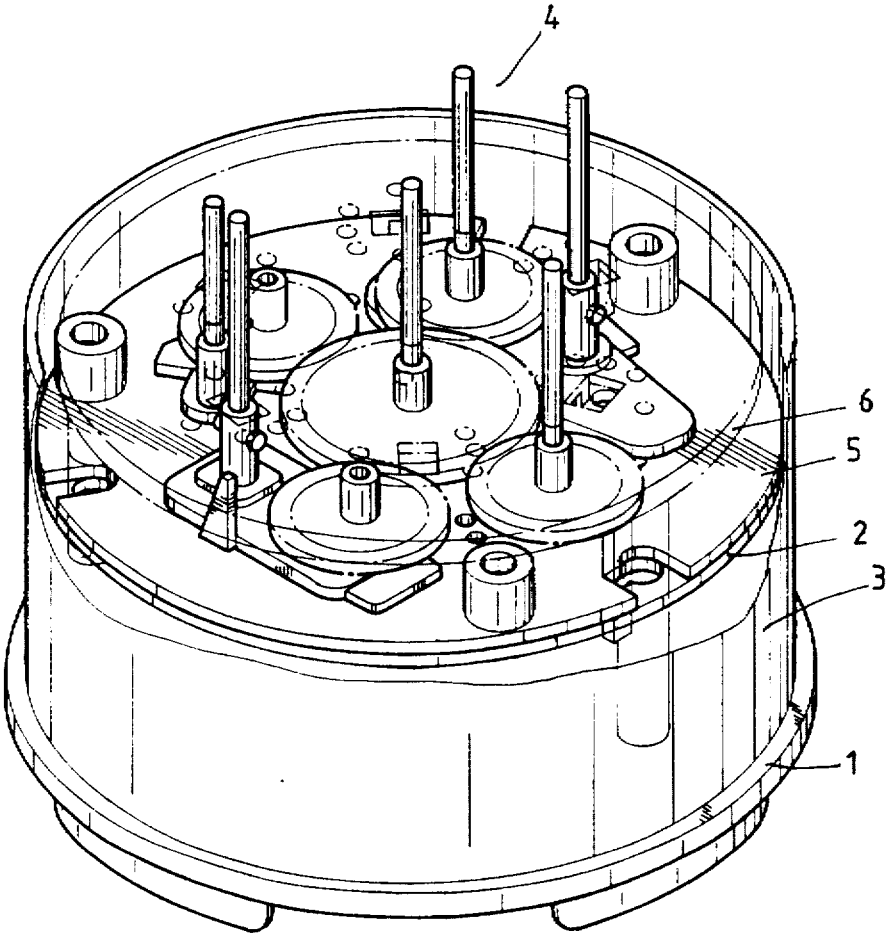
FIG. 2 is a perspective view showing an operation of the present invention.

To assemble the above-mentioned parts together, as shown in FIG. 2, the baffle 2, the base plate 5, the cluster gear 4, the lid 6 and the apron 3 are mounted sequentially from the top of the base 1, and the dolls (not shown in drawings) are fastened on the spin axles 45 and swing links 44 stretching out from the top of the lid 6.

In operating, when the switch is at "ON" position, the electric components of the musical box is in standby state, in this case, if an object blocks the sensor 15, the circuit board 13 will be triggered to transmit music sound through the loudspeaker 14. Meanwhile, the motor 11 is activated which links the driving gear 7 through the worm gear set 12 to drive the master gear 41 of the cluster gear 4. The master gear 41, then driving the epicyclical gears 42 and the spin axles 45 on the linkages 43 to swivel or to rotate sidelong. These swivel and rotation link the dolls to perform in a various manners.

Additionally, upon the completion of playing the song, the motor 11 will be paused by the circuit board 13 until an object blocks the sensor 15 which then restarts the motor 11 and the music IC again to play the next song.

Under normal condition, the driving gear 7 is driven by the motor 15 and the swivel member 71 meshes with the toothed connector 72 securely by the flexure strip 711 urging the projection 712 into the recess 722 on the inner wall of the toothed connector 72 to transfer the rotating force received from the motor 15 through the worm gear set 12 to the cluster gear 4. However, should the doll is held on to cause the rotation of the swivel member 71 to stop, the recess 722 of the toothed connector 72 will urge the projection 712 out which flexes the flexure strip 711. This causes the swivel member 71 in a pausing state, but the toothed connector 72 is still rotating driven by the motor 11 through the worm gear set 12, in this case, the projection 712 slides on the surface of the wave-shaped recesses 722 of the toothed connector 72 and produces a click sound to warn the person release the doll.

I claim:

1. An actuating assembly of a musical box comprising a base, a baffle secured on top of said base, an apron sleeved on to said baffle, a base plate, a lid and a cluster gear, wherein a motor being secured on the top portion of said base and linked to a driving gear through a worm gear set, a circuit board being secured on said base and electrically connected to a loudspeaker, to said motor and to a sensor, said driving gear having a center shaft extending through a center hole of said baffle, and the improvements comprising:

said cluster gear comprising a center master gear, epicyclical gears and linkages, each said epicyclical gear having a cam at a bottom portion thereof extending into a corresponding slotted hole of said linkages, a holder hole being formed at a center portion of said linkage for embedding a swing link therein, and a spin axle being secured on a top portion of each said epicyclical gear and each said linkage respectively;

said base plate comprising a hub hole at a center portion and at least two shaft holes formed around said hub hole for securing said master gear and said epicyclical gears therein, and at least two pin holes around said shaft holes for said spin axles of the linkages passing through;

said lid, corresponding to said hub hole and said shaft holes of said base plate, comprising a through-hole and at least two bushes for securing said cluster gear therin, at least two openings and pin holes being formed between said bushes, some of said openings comprising a pair of opposite support lugs on respective sides for securing said swing links in a pivoting manner, at least two legs extending along a rim of said lid for securing said base thereat; whereas activation of said motor driving said master gear of said cluster gear to rotate for linking dolls secured on the top portion of said swing links and of said spin axles to swivel and to swing.

2. An actuating assembly of a musical box comprising a base, a baffle, an apron, a base plate, a lid and a cluster gear, wherein a motor being fixed on a top portion of said base and rotatably linked to a driving gear through a worm gear set on a center portion of the top of said base; a circuit board being fixed on said base and electrically connected to a loudspeaker, to said motor and to a sensor, said baffle being covered on a top side so that a center shaft of said driving gear passes through a center through hole and is inserted into a master gear of said cluster gear, and said apron being sleeved over a rim of said base; said sensor controlling said motor to pause in a standby state when blocked by a foreign object and replay when unblocked, said sensor facing outwardly through a slotted hole formed through said apron.

3. An actuating assembly of a musical box comprising a base, a baffle, a apron, a base plate, a lid and a cluster gear, wherein a motor being secured to a top portion of said base and rotatably linked to a driving gear through a worm gear set on a center portion of the top of said base; a circuit board being fixed on said base and electrically connected to a loudspeaker, to said motor and to a sensor, said baffle being covered on a top side so that a center shaft of said driving gear passes through a center through hole and is inserted into a master gear of said cluster gear, and said apron being sleeved over a rim of the base;

said driving gear comprising a swivel member and a toothed connector pivoting together, said swivel member having a flexure strip formed on one side along a rim of said swivel member and a projection attached on a free end of said flexure strip, said toothed connector having a holder on a top portion thereof for receiving the swivel member therein, and a circular wave-shaped recess formed on an inner wall of said holder to mesh with said projection; said toothed connector being able to rotate by independent of said swivel member responsive to said swivel member being held by an externally applied force.

* * * * *